US009644589B2

(12) United States Patent
Cavanagh

(10) Patent No.: US 9,644,589 B2
(45) Date of Patent: May 9, 2017

(54) DEBRIS DIVERTER SHIELD FOR FUEL INJECTOR

(71) Applicant: Stanadyne Corporation, Windsor, CT (US)

(72) Inventor: Mark S. Cavanagh, West Granby, CT (US)

(73) Assignee: Stanadyne LLC, Windsor, CT (US)

( * ) Notice: Subject to any disclaimer, the term of this patent is extended or adjusted under 35 U.S.C. 154(b) by 150 days.

(21) Appl. No.: 14/084,840

(22) Filed: Nov. 20, 2013

(65) Prior Publication Data

US 2015/0136088 A1 May 21, 2015

(51) Int. Cl.

| | |
|---|---|
| ***F02M 69/04*** | (2006.01) |
| ***F02M 61/16*** | (2006.01) |
| *F02M 19/06* | (2006.01) |
| *F02D 19/06* | (2006.01) |
| *F02M 37/22* | (2006.01) |

(52) U.S. Cl.

CPC ..... *F02M 61/165* (2013.01); *F02D 19/0668* (2013.01); *F02M 19/066* (2013.01); *F02M 37/22* (2013.01); *F02M 2200/27* (2013.01)

(58) Field of Classification Search

CPC .. F02M 69/04; F02M 61/165; F02M 2200/27; F02M 19/066; F02D 19/0668

USPC ..... 123/456, 468, 469, 470; 210/428, 433.1, 210/453; 239/553, 575, 590

See application file for complete search history.

(56) References Cited

U.S. PATENT DOCUMENTS

| | | | | |
|---|---|---|---|---|
| 4,649,950 | A * | 3/1987 | Bradley et al. | 137/549 |
| 6,502,553 | B2 * | 1/2003 | Banzhaf | F02M 59/366 123/458 |
| 6,688,579 | B2 * | 2/2004 | Grytz | F02M 47/027 251/129.16 |
| 6,811,138 | B2 * | 11/2004 | Kuehne | F02M 47/027 251/129.15 |
| 6,820,858 | B2 * | 11/2004 | Haeberer | F02M 47/027 251/129.16 |
| 8,297,259 | B2 * | 10/2012 | Kondo | F02M 47/027 123/470 |
| 8,470,168 | B2 * | 6/2013 | Brun | F02C 7/224 210/130 |
| 8,590,513 | B2 * | 11/2013 | Kondo et al. | 123/494 |
| 2003/0141475 | A1 * | 7/2003 | Ruthardt | F02M 47/027 251/129.16 |

(Continued)

FOREIGN PATENT DOCUMENTS

| | | | | |
|---|---|---|---|---|
| DE | 102007029793 | A1 * | 7/2008 | F02M 47/02 |
| DE | WO 2010023024 | A1 * | 3/2010 | F02M 47/027 |

(Continued)

*Primary Examiner* — Hung Q Nguyen
*Assistant Examiner* — Kevin R Steckbauer
(74) *Attorney, Agent, or Firm* — Alix, Yale & Ristas, LLP

(57) ABSTRACT

A tubular debris shield and diverter mounted in a high pressure flow passage within a fuel injector, provide the dual functions of passing the main flow of high pressure fuel with large debris particles to relatively large discharge openings, such as the injector spray holes, while allowing some high pressure fuel to flow through a multitude of very small transverse holes to a sensitive hydraulic component, such an injector control valve circuit. In one embodiment, the tube has a wall thickness in the range of about 0.1 to 0.5 mm at least about 2000 holes with a diameter in the range of about 20 to 30 microns.

16 Claims, 3 Drawing Sheets

(56) References Cited

U.S. PATENT DOCUMENTS

| | | | | |
|---|---|---|---|---|
| 2004/0026540 | A1* | 2/2004 | Haeberer | F02M 47/027 239/585.1 |
| 2004/0069863 | A1* | 4/2004 | Mattes | F02M 47/02 239/88 |
| 2005/0029179 | A1* | 2/2005 | Hatz | F02M 61/165 210/171 |
| 2007/0261673 | A1* | 11/2007 | Rueckle | F02M 47/027 123/445 |
| 2010/0263633 | A1* | 10/2010 | Kondo | F02M 47/027 123/478 |
| 2011/0061835 | A1* | 3/2011 | Brun | F02C 7/224 165/100 |
| 2015/0008271 | A1* | 1/2015 | Mack | 239/575 |

FOREIGN PATENT DOCUMENTS

| | | | | |
|---|---|---|---|---|
| DE | 102011053113 | A1 * | 2/2013 | F02M 61/165 |
| JP | 2004122100 | A * | 4/2004 | B01D 35/02 |
| WO | WO 2006018440 | A1 * | 2/2006 | F02M 61/16 |
| WO | WO 2007012433 | A1 * | 2/2007 | F02M 47/02 |
| WO | WO 2010023024 | A1 * | 3/2010 | F02M 47/027 |

* cited by examiner

DEBRIS DIVERTER SHIELD FOR FUEL INJECTOR

BACKGROUND

The present invention relates to fuel injectors, particularly for vehicle internal combustion engines.

In a well-known type of fuel injector, an injection valve is hydraulically opened and closed by the opening and closing of a solenoid actuated control valve. Both valves are subject to highly pressurized fuel from a supply pump or common rail. To reduce engine emissions, fuel systems are being designed for injection at higher and higher pressure. To seal high pressure fuel during closure of the control valve, it is necessary to increase the hold-down force and thereby avoid seat leakage at these higher pressures.

The higher control valve seating force increases the potential for seat damage when debris gets trapped or crushed in the opening and closing control valve. To meet more stringent emissions regulations it has been found that injecting fuel multiple times during one combustion event is required. To achieve fast opening and closing of the fuel injectors, faster opening and closing control valves with less valve lift are being adopted. Control valve lifts under 50 microns are common. Ideally, debris should to be small enough to pass through the valve seat area.

Debris that gets trapped in the seat area will continue to damage that seat as it opens and closes. This significantly reduces the life of the injectors. When damaged, control valve seats no longer seal properly. Fuel delivered by the fuel injector tends to increase when control valve seats leak. This performance change results in unintended fuel delivery increases which can cause engine damage due to over fueling and also rough engine operation due to uneven fuel delivery into the various engine cylinders. As a consequence, the most common reason for replacing fuel injectors is performance problems caused by control valve seat damage.

Techniques are known for addressing this problem to some extent. The fuel from the fuel tank is filtered through multiple filters prior to reaching the fuel injector but some debris gets through these filters. Primary and secondary filters are located between the fuel tank and the entrance to the high pressure fuel pump. At the entrance to the fuel injector a third, small filter functions at the high pressures produced by the high pressure pump. The primary and secondary filters trap about 99% of the debris in the fuel prior to entering the high pressure fuel pump. The remaining debris in the fuel and additional debris from components such as the high pressure pump become trapped in the small filter (typically an edge filter or laser drilled filter).

Filters used to capture debris at the entrance of the injector are challenging to design at a reasonable cost. These filters typically are not serviced over the life of the injector and to avoid plugging, are theoretically designed to allow debris particles smaller than 30 microns to 60 microns in diameter to pass. In general, however, the filter at the entrance to the injector typically will permit particles smaller than about 50 microns to pass. This does not present a plugging problem with respect to the discharge holes for fuel injection, which are typically larger than 100 microns, but does present a problem for the durability of the control valve. Rod-shaped particles that have a diameter under 60 microns but a length of up to 150 to 200 microns can still pass through the entrance filters. These particles cause damage if they pass into the control valve.

Even if the edge region of an entrance edge filter is designed with a 50 micron passage, larger particles are not permanently trapped but, rather, extrude through the passage as rods or flakes with an effective diameter of about 50 microns. Thus, the overall volume of debris reaching the control valve is not reduced by the typical entrance filter. The control valve must hammer the extruded debris down to a size that will pass through the control valve.

SUMMARY

The object of the present invention is to avoid debris damage to a hydraulic component within a fuel injector, particularly a control valve for a needle injection valve, by limiting the debris that reaches the component to a size that can readily pass through the component.

In the case of such control valve, the debris is preferably limited to an effective diameter of less than 50 microns, especially less than 25 microns.

This object is achieved by providing a simple, low-cost filter-type device in a small space inside the injector, which remains in place during the life of the injector without plugging.

The device is in essence a tubular debris shield and diverter in a high pressure flow passage within the injector, providing the dual function of passing the main flow of high pressure fuel with large particles that get through the entrance filter down to relatively large discharge openings, such as the injector spray holes, while allowing some high pressure fuel to flow through a multitude of very small transverse holes to the hydraulic component, such as into the injector control valve circuit.

The small holes prevent debris from passing through the wall of the tube and the flow through the center of the tube carries debris that attempts to plug these small holes to the injector spray holes. The main flow washes away the particles and helps prevent the small holes from plugging.

In one aspect, the disclosure is directed to a debris shield in the high pressure fuel supply passage upstream of a branch line leading to the control valve, comprising a tube fixed to the injector body, with a central passage aligned with the main fuel supply passage and a multiplicity of transverse holes through which high pressure fuel is delivered to the branch line. In this way, high pressure fuel for injection passes axially through the tube and high pressure fuel to the upstream side of the control valve passes radially through the holes in the tube.

Damaging debris has higher density than fuel, so the debris is more likely to travel past the small holes, which are preferably 90 degrees to the main flow. The small holes (approximately 20-25 microns) are less likely to plug due to the 90 degree change in particle direction required for the particles to enter the small holes.

The debris at the entrance to the holes is not subject to a significant pressure drop across the holes so, unlike in edge filters, no extrusion forces arise that would otherwise force larger particles through the holes. The transverse entrance to the holes acts like a shield to minimize the penetration of debris into the holes. Furthermore, larger particles at the entrance to the holes are flushed away (i.e., diverted) from the holes in the main axial flow through the tube.

Thus, an important advantage of the present invention is that large particles are neither accumulated nor extruded, and particles that do pass through the diverter shield have an effective size that enables them to pass readily through the control valve without being hammered to a smaller size.

In the preferred embodiment, the injector body comprises an upper portion containing the control valve and an upper portion of the fuel supply passage, a lower portion containing the injector valve and a lower portion of the fuel supply passage, and a distinct central plate portion having upper and lower surfaces rigidly trapped between the upper and lower portions of the body and a debris shield chamber fluidly connecting the upper and lower portions of the fuel supply passage. The debris shield is situated in the shield chamber, with opposed ends extending from the upper to the lower surface of the central portion of the body. The tube is fixed to the body in longitudinal compression between the upper and lower portions of the body.

The placement of the debris shield in a central plate with slight protrusions of the tube above the plate, allows the tube to be crushed a controlled amount. The plate thickness is easy to control to close dimensions. The unique configuration of the tube into the plate is very beneficial as a low cost modification and for ease of manufacturing. Because the tube is made of material that can yield without cracking, the dimensional control of the tube length is relaxed, which helps reduce cost. The tube is crushed and slightly yielded to assure that it seals against the upper and lower portions of the body. It is important to seal the tube on both ends to assure that no leakage occurs that would allow large particles to enter the control valve fluid passages.

BRIEF DESCRIPTION OF THE DRAWING

Embodiments of the invention will be described below with reference to the accompanying drawing, in which.

DETAILED DESCRIPTION

Figure 1:
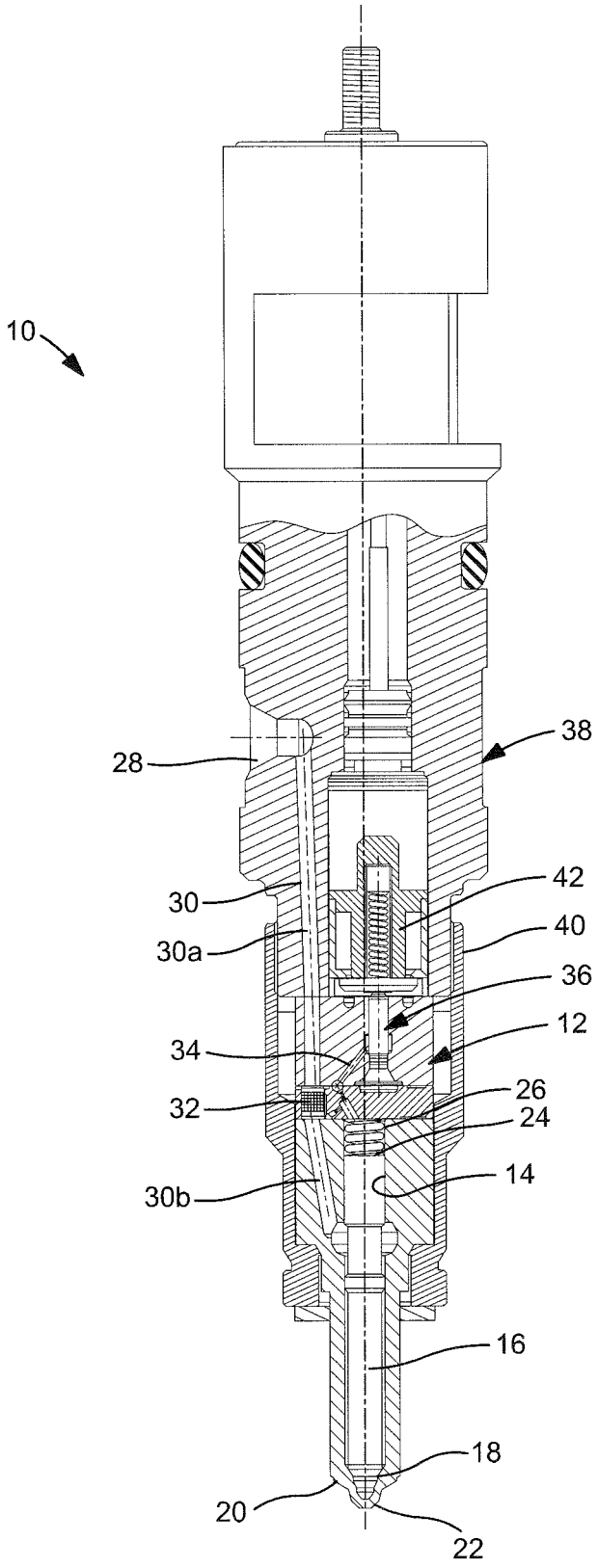
FIG. 1 is a longitudinal section view of a fuel injector that incorporates a first embodiment.

FIG. 1 shows an injector 10 that embodies one aspect of the present invention. The injector has a body 12 including a central bore 14 in which a needle valve 16 reciprocates axially to selectively seal against and lift off seat 18 in the lower portion near tip 20 of the body. A plurality of injection holes or orifices 22 are formed in the tip below the valve seat 18. The needle valve 16 has an upper end 24 situated in a needle control chamber 26 whereby a combination of hydraulic and spring forces selectively close the nose of valve 16 against seat 18 or lift the valve 16 from the seat 18, depending on the pressure in chamber 26.

After passing through a high pressure filter (not shown), high pressure fuel is supplied to the injector through port 28 into main passage 30, having upper portion 30*a*, which leads to the valve body 12, and lower portion 30*b*, which is in fluid communication with the bore 14. In a well-known manner, differential area profiles and fluid volumes on and around needle 16 achieve the desired hydraulic balances such that high pressure fuel is selectively discharged through orifices 22. When the needle valve 16 is to be closed, high pressure fuel in the needle control chamber 26 urges the injector valve 16 against the injector valve seat 18 to prevent flow of high pressure fuel from the bore 14 to the orifices 22 and when the needle valve is to be opened the needle control chamber 26 is fluidly connected to low a pressure sump, thereby reducing the fluid pressure in the control chamber 26 and on the upper end 24 of the needle valve 16, lifting the needle valve off the injector seat 18 and discharging fuel through the orifices 22.

Figure 2:
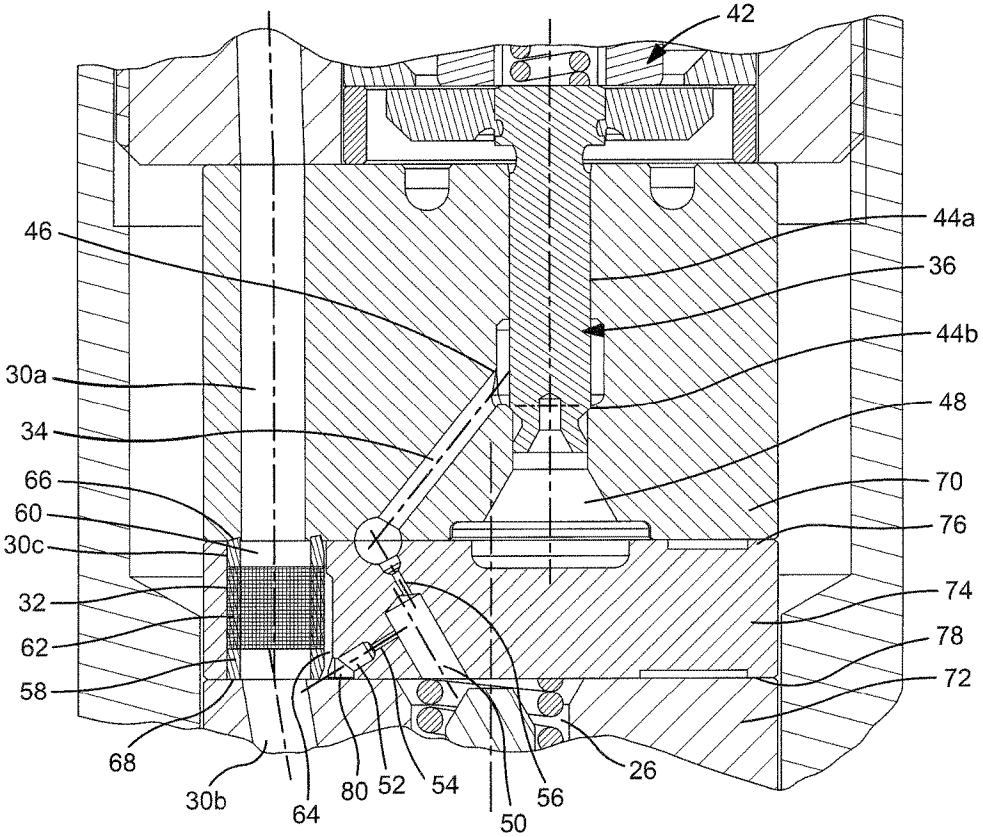
FIG. 2 is a detailed section view of the first embodiment.

With reference to FIGS. 1 and 2, the invention provides a debris shield 32 within the injector, where some of the high pressure fuel is delivered from the high pressure supply passage (e.g., 30*a*) via auxiliary passage or branch 34 to control valve 36. Control valve 36 is in fluid communication with and controls the pressure in the needle control chamber 26, thereby closing and opening the needle valve 16. An actuator body 38 is connected to the valve body 12 by threading to a substantially tubular body connector 40, and contains a solenoid actuator 42 for a pintle 44*a* or the like that seals against and lifts from seat 44*b*. Seat 44*b* is located such that an upstream region 46 of the control valve chamber is in fluid communication with high pressure passage 34 and a downstream region 48 is in fluid communication with a low pressure sump, such as the fuel tank or low pressure fuel delivery line to the high pressure supply pump.

In the illustrated embodiment, the auxiliary flow from high pressure supply passage 30*a* enters passage 50 via passage 52, the former being in direct fluid communication with the needle control chamber 26 and with passage 34. Preferably, the auxiliary passage 52 includes an orifice 54 leading to passage 50, and another orifice 56 is situated between passage 50 and passage 34.

The debris shield 32 is in the intermediate portion 30*c* of the high pressure fuel supply passage 30, between portions 30*a* and 30*b*. The debris shield comprises a tube 58 with a central axial passage 60 and a multiplicity of radial holes 62 through the tube wall. High pressure fuel for injection passes axially into and out of the tube 58 and high pressure fuel to the upstream side 46 of the control valve 36 passes radially through the holes 62 in the tube. In the illustrated embodiment, the debris shield is in the high pressure fuel supply passage 30*c* upstream of branch passage 52, whereby radial flow through the debris shield enters the passage 50 and passage 34. However, inasmuch as the main purpose of the debris shield is to prevent debris from entering the control valve 36, the upstream flow path 34 can be directly fluidly connected to the fluid volume where the radial flow exits the debris shield.

It should thus be appreciated that the debris shield 32 is in the main high pressure fuel supply passage 30, upstream of the branch line 34 leading to the control valve 36, and comprises a tube or the like 58 fixed to the body 12, with a central passage 60 aligned with the fuel supply passage and a multiplicity of transverse holes 62 through which high pressure fuel is delivered to the branch line 34.

The debris shield 32 is preferably situated in a shield chamber 64 in the body, defined by a shield chamber wall spaced radially from the tube. The tube has opposed ends 66, 68 and the tube is fixed to the body at the ends. Preferably the valve body 12 comprises an upper portion 70 containing a vertical portion of high pressure supply passage 30*a*, control valve seat 44*b*, and upstream entry point 46 of passage 34 to the seat 44*b*. The valve body 12 also includes a lower portion 72 containing the injector valve 16, needle control chamber 26, and the lower portion 30*b* of the fuel supply passage 30. A distinct central portion 74 of the valve body 12 in the form of a plate having upper and lower surfaces 76, 78 is rigidly trapped between the upper and lower portions 70, 72 of the body. The shield chamber 64 fluidly connects the upper and lower portions 30*a*, 30*b* of the fuel supply passage. Auxiliary passage 52, passage 50 to the needle control chamber 26, and orifices 54 and 56 are also preferably located in the central plate 74.

The nominal distance between opposed ends 66, 68 of the tube 58 is preferably greater than the distance between the upper surface 76 and the lower surface 78 of the central portion 74 of the body, However, in the assembled condition of the injector, the body portions 70, 72, and 74 are pulled tightly together by the body connector 40 (See FIG. 1) so that tube 58 is fixed to the body in longitudinal compression between the upper and lower portions 70, 72 of the body.

The shield chamber 64 preferably includes a collection gallery 80 at the intersection with the auxiliary passage 52. All the fuel supplied to the passage 34 must pass through the holes 62 and gallery 80. Preferably, the gallery extends to the lower surface 78 of the central portion 74 of the body, and auxiliary passage 52 extends from the lower surface of the central portion of the body from the gallery at an oblique upward angle toward the axis of the bore 14. Passage 50 terminates within the central portion 74 of the body between the first and second orifices 54, 56 and is oriented along an axis from the injector control chamber obliquely upward toward the first portion 30*a* of the fuel supply passage.

The holes 62 of the debris shield have a diameter less than 30 microns, preferably about 20 microns. The control valve pintle 44*a* is actuated by solenoid 42 to seal against and lift from a seat 44*a* with a minimum lift, and the diameter of the holes 62 in the tube should be smaller than this minimum lift. The material composition and wall thickness of the tube 58 should be such that the tube compresses during installation without excessive strain that would affect the diameter of the holes 62.

Figure 3:
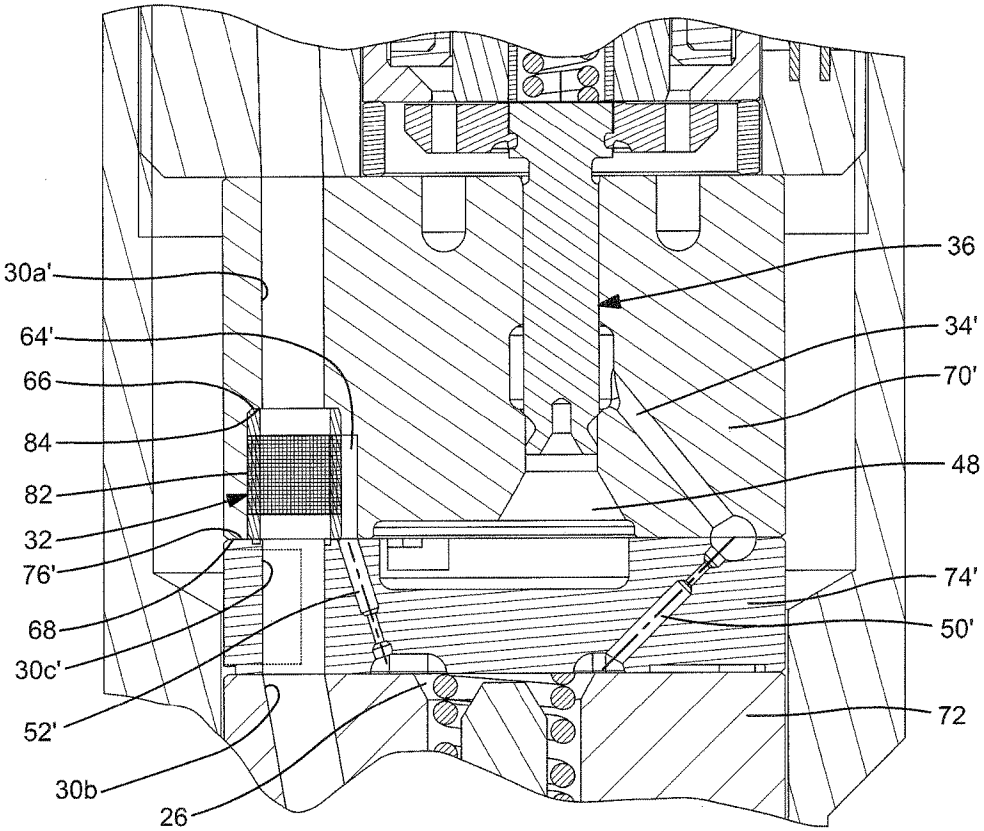
FIG. 3 is a detailed section view of a second embodiment.

FIG. 3 shows a second embodiment in which the debris diverter shield 32 is in a different location within the injector, and the associated passages for achieving control of the injector differ from those shown in FIG. 2 In FIG. 3, components which are identical to those shown in FIG. 2 carry the same numeric identifier, whereas components that are not identical but provide the same or similar functionality are indicated with a prime (').  In this embodiment, the debris shield 32 is located in the upper portion 30*a*' of the high pressure passage within the upper block 70', and the lower portion 30*b* in block 72 and intermediate portion 30*c*' in block 74' are straight bores.

The lower portion of passage 30*a*' has a counter bore 82 defining an internal shoulder 84. The upper end 66 of the diverter shield 32 bears against the shoulder 84 and the lower end 68 of the diverter shield 32 bears against the upper surface 76' of the intermediate block 74'. As with the embodiment of FIGS. 1 and 2, the diverter shield 32 is thereby compressed and rigidly held in position.

High pressure fuel in passage 30*a*' enters the debris diverter 32, with some flow passing through the transverse holes into gallery 64', branch line 52' and into the needle control chamber 26. While the control valve 36 is closed, high pressure is maintained in the needle control chamber 26, passage 50' and passage 34'. Upon lifting of the control valve 36, this pressurized fuel is exposed to the low pressure at 48, thereby inducing the lifting of the needle valve within chamber 26.

It should be appreciated that a tubular, perforated debris diverter shield can be located anywhere within the injector whereby a main high pressure fuel flow passes axially through the tube and a secondary or auxiliary flow passes transversely through the perforations to a component within the injector that is vulnerable to the presence of small particles of debris. Particularly in the illustrated and analogous embodiments, the pressure drop across the perforations or holes is relatively small. For example, while the control valve 36 is closed, there is substantially no pressure drop because the passages to the control valve are at the pressure of the fuel in supply line 30. When the control valve 36 opens, the orifices such as at 54 and 56 maintain a relatively high pressure in the gallery 64. Even with pressure in the main passage 30 above 20,000 psi, the pressure drop across the holes can be as low as about 30 psi. One can trade off the lower cost of laser drilling fewer holes against the increase in pressure drop to, e.g., about 100 psi.

The combination of robust main flow axially through the tube, transverse orientation of the perforations, and small pressure drop across the perforations, avoids substantial transverse forces on the particles so they do not even begin extruding through the holes. Due to the low transverse forces on the particles they tend to remain near the entrances to the perforations and are immediately flushed by the main flow to the region of the injector where they can easily pass through the injection orifices.

It should be appreciated that in a typical implementation for a passenger vehicle, the debris diverter shield 32 would have a length in the range of about 3-4 mm, an OD of about 2.5 mm, and an ID of about 1.5 mm (e.g., with a wall thickness in the range of about 0.1 to 0.5 mm), and at least about 2000 holes with a diameter in the range of about 20 to 30 microns. However, the dimensions of the diverted shield and the number of holes would be correspondingly larger for heavier end uses, but the size of the holes should remain in the same range for use with the same type of fuel having similar debris characteristics.

The present invention has exhibited a remarkable reduction in the effects of debris contamination in the typical fuel flow to an injector control valve. Raw fuel contains debris having a size up to 1000 microns. Typical filters upstream of the injector permit debris of up to 60 microns effective diameter to pass through to the injector and additional debris may be introduced into the fuel by hardware components in the fuel line downstream of the filters. Typical edge filters at the injector cannot filter debris smaller than 30-50 microns and debris of larger size is extruded and thereby reduced in size in the range of 30-50 microns before entering the main passage in the injector. Typical fuels have so much debris that even if large particles were diverted within the injector to an accumulation chamber or the like, the capacity would not be large enough to handle the diverted debris accumulated over only a fraction of the desired service life of the injector. The extent of debris reduction according to the invention can vary with particle size distribution in the fuel. However, a comparison of total debris reaching the control valve as between a conventional fuel system with fuel line filter and edge filter at the entrance to the injector, and the same system but with the addition of a debris diverter shield as shown and described herein, showed a reduction by a factor of over 10.

The invention claimed is:

1. A fuel injector comprising:

an elongated body having upper and lower ends, a longitudinal bore leading to an injector valve seat adjacent the lower end and to a tip with discharge holes at the lower end;

an injector valve reciprocable in said bore, having a lower end sealable against the injector valve seat and an upper end subject to fluid pressure in an injector control chamber;

a control valve with an upstream side in fluid communication with said injector control chamber and a downstream side in fluid communicating with a low pressure sump;

a high pressure fuel supply passage in the body, in fluid communication with said bore upstream of the injector valve seat, and a branch line from the high pressure passage in fluid communication with said injector control chamber and with the upstream side of said control valve;

an actuator for selectively closing and opening the control valve, whereby when the control valve is closed high pressure fuel in said control chamber urges the injector valve against the injector valve seat to prevent flow of high pressure fuel from said bore to the discharge holes and when the control valve is opened the control chamber is fluidly connected with the low pressure sump, thereby reducing the fluid pressure in the control chamber and on the upper end of the injector valve, lifting the injector valve off the injector seat and discharging fuel through the discharge holes;

a debris shield in the high pressure fuel supply passage upstream of said branch line, comprising a tube fixed to the body, with a central passage aligned with the fuel supply passage and a tube wall with a multiplicity of individual radial bore holes passing entirely through the tube wall;

wherein the body comprises an upper portion containing the control valve and an upper portion of the fuel supply passage, a lower portion containing the injector valve and a lower portion of the fuel supply passage, and a distinct central portion having upper and lower surfaces rigidly trapped between the upper and lower portions of the body and a shield chamber fluidly connecting the upper and lower portions of the fuel supply passage;

wherein the debris shield is situated in the shield chamber; and wherein the tube has opposed ends extending from the upper to the lower surface of the central portion of the body, and the tube is fixed to the body in longitudinal compression between the upper and lower portions of the body, by compressive engagement with the lower surface of the upper portion and compressive engagement with the upper surface of the lower portion.

2. The injector of claim 1, wherein the debris shield is situated in a shield chamber in the body, and the shield chamber is defined by a shield chamber wall spaced radially from the tube.

3. The injector of claim 1, wherein the tube has opposed ends and the tube is fixed to the body at the ends.

4. The injector of claim 1, wherein the shield chamber is defined by a shield chamber wall spaced radially from the tube.

5. The injector of claim 1, wherein said branch line leads from the shield chamber to a first (Z) orifice which delivers fuel to a first passage leading to the injector control chamber;

a second (A) orifice is provided between the first passage and a second passage leading to the control valve; and the branch line and first and second orifices are in the central portion of the body.

6. The injector of claim 1, wherein the shield chamber is defined by a shield chamber wall spaced radially from the tube and including a collection gallery; and the branch line extends from the collection gallery into the central body portion.

7. The injector of claim 5, wherein the shield chamber is defined by a shield chamber wall spaced radially from the tube and including a collection gallery; and the branch line extends from the collection gallery into the central body portion.

8. The injector of claim 7, wherein the upper portion of the fuel supply passage and the tube are coaxially aligned at the upper surface of the central portion of the body, along a first axis that is parallel to and laterally offset from the bore;

fuel from the upper portion of the fuel supply passage must pass through the holes and gallery before flowing to said branch line;

the gallery extends to the lower surface of the central portion of the body;

the branch line extends from the lower surface of the central portion of the body from the gallery at an oblique upward angle toward the axis of the bore;

said first passage terminates within the central portion of the body between the first and second orifices and is oriented along an axis from the injector control chamber obliquely upward toward the upper portion of the fuel supply passage.

9. The injector of claim 1, wherein the holes have a diameter less than 50 microns.

10. The injector of claim 9, wherein the holes have a diameter less than 25 microns.

11. The injector of claim 1, wherein the tube has a length in the range of 3-4 mm, said wall has a thickness in the range of 0.1 to 0.5 mm, and the tube has at least 2000 holes with a diameter in the range of 20 to 30 microns.

12. The injector of claim 1, wherein high pressure fuel for injection passes axially through the tube and all high pressure fuel from the central passage delivered to the upstream side of the control valve passes entirely through the radial bore holes in the tube wall before delivery to the control valve.

13. The injector of claim 12, wherein the tube is situated in a shield chamber having a gallery outside the tube for accumulating fuel that has passed through the holes;

all the high pressure fuel for injection passes axially through the tube and all the high pressure fuel to the upstream side of the control valve passes from the gallery through at least one orifice.

14. The injector of claim 13, wherein the control valve has a pintle that is actuated by a solenoid to seal against and lift from a seat with a minimum lift and the diameter of the holes in the tube is smaller than said minimum lift.

15. The injector of claim 12, wherein the holes have a diameter of less than 0.025 mm.

16. The fuel injector of claim 1, wherein the control valve has a pintle that is actuated by a solenoid to seal against and lift from a seat with a minimum lift, and the diameter of the holes in the tube is smaller than the minimum lift.

* * * * *